US006747629B2

(12) United States Patent
Broker

(10) Patent No.: US 6,747,629 B2
(45) Date of Patent: Jun. 8, 2004

(54) ADJUSTING CONTRAST BASED ON HEATING AND COOLING RATE

(75) Inventor: John F. Broker, Colfax, IA (US)

(73) Assignee: Maytag Corporation, Newton, IA (US)

( * ) Notice: Subject to any disclaimer, the term of this patent is extended or adjusted under 35 U.S.C. 154(b) by 315 days.

(21) Appl. No.: 09/867,039

(22) Filed: May 29, 2001

(65) Prior Publication Data

US 2002/0180599 A1 Dec. 5, 2002

(51) Int. Cl.[7] ..... G09G 3/36

(52) U.S. Cl. ..... 345/101; 345/87; 345/97; 348/61; 219/679; 219/720

(58) Field of Search ..... 345/87, 97, 101; 348/61; 219/679, 720

(56) References Cited

U.S. PATENT DOCUMENTS

| | | | | |
|---|---|---|---|---|
| 4,236,150 | A | | 11/1980 | Chern |
| 4,278,325 | A | | 7/1981 | Kondo et al. |
| 4,338,600 | A | | 7/1982 | Leach |
| 4,368,408 | A | | 1/1983 | Marcus |
| 4,390,874 | A | | 6/1983 | Woodside et al. |
| 4,460,247 | A | | 7/1984 | Hilsum et al. |
| 4,462,027 | A | | 7/1984 | Lloyd |
| 4,625,163 | A | | 11/1986 | Germer |
| 4,745,403 | A | | 5/1988 | Tamura |
| 4,902,107 | A | | 2/1990 | Tsuboyama et al. |
| 4,914,357 | A | | 4/1990 | Valley |
| 4,923,285 | A | | 5/1990 | Ogino et al. |
| 5,029,982 | A | * | 7/1991 | Nash ..... 349/72 |
| 5,033,822 | A | | 7/1991 | Ooki et al. |
| 5,283,564 | A | | 2/1994 | Katakura et al. |
| 5,414,441 | A | | 5/1995 | Memarzadeh et al. |
| 5,515,074 | A | | 5/1996 | Yamamoto |
| 5,711,606 | A | * | 1/1998 | Koether ..... 374/149 |
| 5,748,171 | A | | 5/1998 | Ishizaki et al. |
| 5,926,162 | A | | 7/1999 | Wood et al. |
| 6,075,511 | A | | 6/2000 | Iwasaki et al. |
| 6,142,666 | A | | 11/2000 | Koether et al. |

* cited by examiner

*Primary Examiner*—Steven Saras
*Assistant Examiner*—Ming Liu
(74) *Attorney, Agent, or Firm*—McKee, Voorhees & Sease, P.L.C.

(57) ABSTRACT

An electronically controlled appliance capable of automatically adjusting a contrast level of a data display module is disclosed. The device includes an appliance, an intelligent control electrically connected to the appliance and adapted for controlling the appliance, a data display module capable of contrast adjustment and electrically connected to the intelligent control, a data storage medium electrically connected to the intelligent control storing software instructions for monitoring the amount of time the appliance is in an active state and instructions for compensating for the temperature change associated with the amount of time by adjusting the contrast level of the data display module.

7 Claims, 6 Drawing Sheets

ADJUSTING CONTRAST BASED ON HEATING AND COOLING RATE

BACKGROUND OF THE INVENTION

This invention relates to a method and apparatus for adjusting contrast based on heating and cooling rates. More specifically, this invention relates to adjusting the contrast level of a data display module in an appliance.

Appliances such as dishwashing machines, clothes washing machines, clothes drying machines, electric ranges, as well as other appliances may now contain data display modules such as LCD panels. In these types of appliances, there are problems with the use of LCD panels or other display modules. The problem relates to the temperature of the data display module. As the appliance heats up the data display module fades due to the temperature increase. The fading of the data display module obscures the display from the user of the appliance or otherwise makes the display difficult to read.

If the data display module allows for user adjustment of the contrast level of the data display module, then a user can adjust the contrast to compensate for the fading of the LCD when the appliance heats up. Eventually, however, after the appliance is turned off or otherwise begins to cool, the user will have to adjust the contrast level to compensate for the prior adjustment made.

Various methods of automatically or electronically adjusting data display modules have previously been used. One such method is to use a temperature sensor to measure the temperature of a data display module and then alter the contrast level based on the temperature sensed at the LCD device. This has been accomplished through use of a feedback circuit or through application of a mathematical relationship between the temperature-measured and a voltage or a frequency to be applied to a liquid crystal display. One problem with this methodology is that a temperature sensor is required. This adds to the cost of manufacturing and may affect the reliability of the device.

Thus, it is a primary object of the present invention to provide a method and apparatus for control of the contrast level of the data display module in an appliance which improves upon the state of the art.

Another object of the present invention is to provide an apparatus and method for compensating for temperature changes in a data display module which does not require a temperature sensor.

Yet another object of the present invention is to provide a method and apparatus of adjusting the contrast level of a data display module in an appliance that does not significantly add to the cost of the manufacturing the appliance.

A further object of the present invention is to provide a method and apparatus for adjusting the contrast level of the data display module in an appliance that may be implemented in software.

A still further object of the present invention is to provide an apparatus and method for adjusting a contrast level of a data display module in an appliance that can take into account operator adjustments of the contrast level.

These and other objects, features, or advantages of the present invention will become apparent from the Specification and claims.

BRIEF SUMMARY OF THE INVENTION

The present invention is a method and apparatus for automatically adjusting the contrast level of a data display module in an appliance. The apparatus of the invention provides for an appliance having an intelligent control electrically connected to the appliance and adapted for controlling the appliance, a data display module capable of contrast adjustment electrically connected to the intelligent control, and a data storage medium electrically connected to the intelligent control storing software instructions for monitoring the amount of time the appliance is in an active state, and instructions for compensating for the temperature change associated with the amount of time by adjusting the contrast level of the data display module.

The invention determines whether the appliance is in an active state, and then estimates the temperature change in the data display module that is to be compensated for based upon the amount of time the appliance has been in the active state. The invention then adjusts the contrast level to the data display module to compensate for the temperature change in the data display module.

Another aspect of the invention is to compensate for the condition that occurs when the appliance enters the active state prior to being fully cooled. A further aspect of the present invention is to compensate for any user adjustment of the contrast level. Thus the present invention provides for the advantages of not requiring a temperature sensor to compensate for temperature changes in a data display and module. This allows for automatic contrast adjustment of a data display module without requiring increased manufacturing costs.

DETAILED DESCRIPTION OF THE INVENTION

Figure 1:
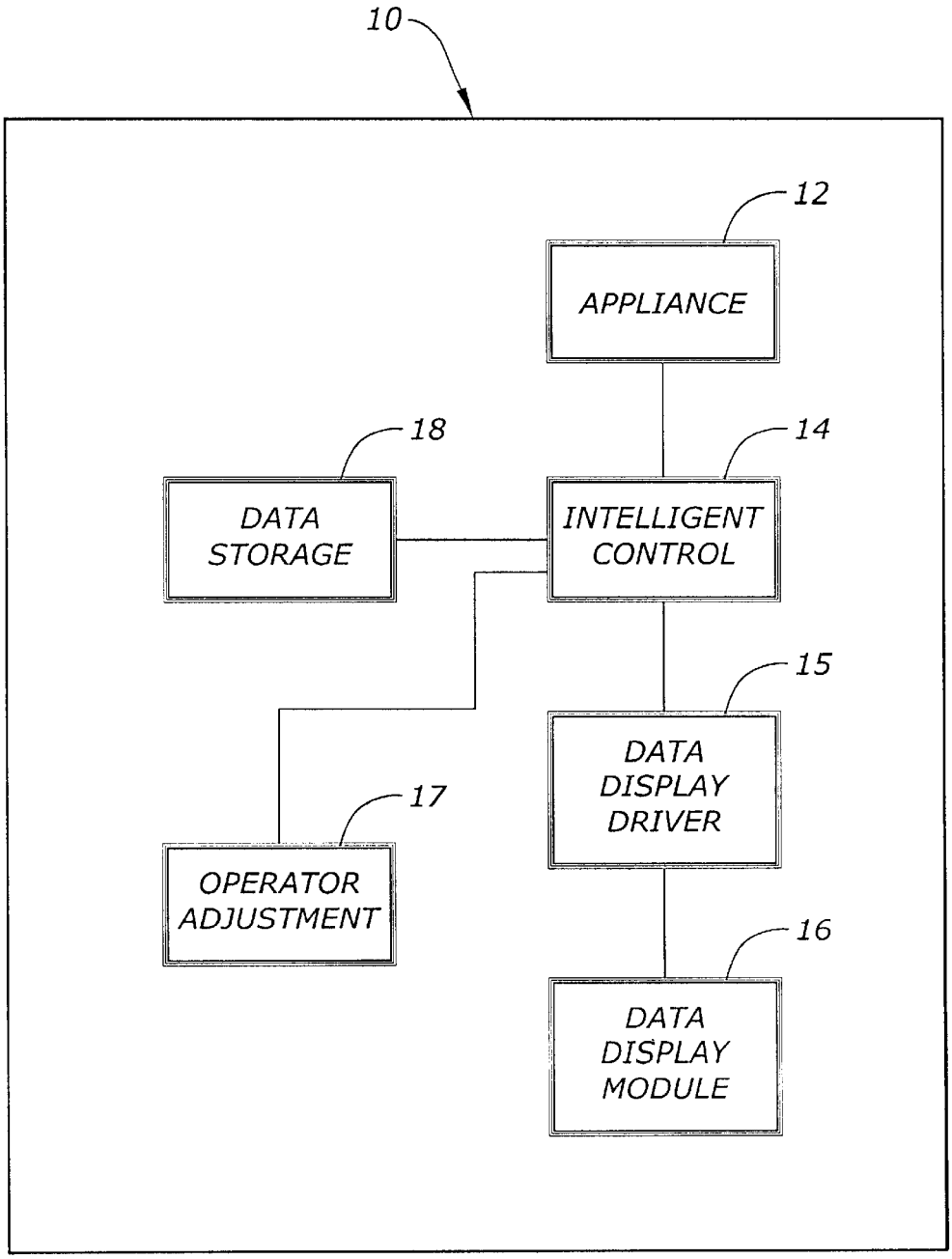
FIG. 1 is a block diagram of the electronically controlled appliance of the present invention.

FIG. 1 illustrates the electronically controlled appliance 10 of the present invention. In FIG. 1, an appliance 12 is shown. The appliance may be a dishwashing machine, a clothes washing machine, a clothes dryer, an electric range, a cooking appliance, or any other appliance such as may be found in a home or a commercial establishment. The appliance 12 is electrically connected to an intelligent control 14. The intelligent control may be a microcontroller, a processor, a microcomputer, an integrated circuit, or other intelligent control. One example of an intelligent control that may be used with the present invention is the Sharp LH77790 microcontroller. A data display driver 15 is electrically connected to the intelligent control 14. The data display driver 15 is also electrically connected to data display module 16. The data display driver may be integrated with the intelligent control 14, or else a separate data display driver may be used. The Sharp LH77790 microcontroller includes an integrated data display driver capable of controlling a liquid crystal display (LCD) panel. One example of a data display module 16 that may be used with the present invention is the Sharp LCD LM3201921 panel. This panel is a Quarter VGA (QVGA) display having a resolution of 320 by 240 pixels. The display also uses cold cathode backlight (CCFT).

The present invention also provides for an operator adjustment 17 for manually operated control of the contrast level of the data display module. The operator adjustment 17 is electrically connected to the intelligent control 14. The present invention also contemplates that the operator adjustment 17 may be electrically connected to the data display driver 15.

The intelligent control 14 is electrically connected to data storage 18. Data storage 18 provides a memory or cache for storing instructions and/or data used by the intelligent control 14. The data storage 18 may be integrated into the intelligent control or may be a separate unit. For example, the LH77790 embedded microcontroller has an integrated instruction and data cache.

Figure 2:
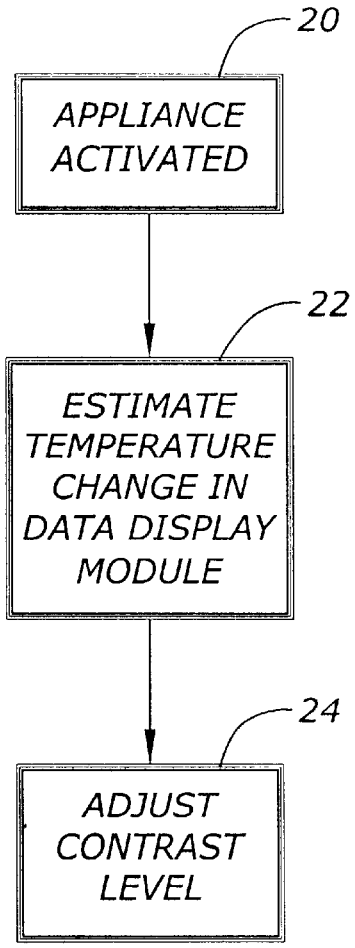
FIG. 2 is a flow chart of the present invention.

FIG. 2 illustrates a method of the present invention wherein the appliance is activated. Activation occurs when a heating element is turned on, a cooking process begins, a washing process begins, a drying process begins or other action is initiated that may result in the temperature of the data display module increasing.

The intelligent control 14 is capable of determining when the appliance is activated through monitoring the state of an input or output electrically connected to the appliance or otherwise monitoring state.

In step 22 an estimate of the temperature change in the data display module is made. For example, when the method is implemented in software, the intelligent control can measure or otherwise calculate the amount of time that the appliance has been active. Based on this amount of time, a temperature change in the data display module is predicted. This estimation can be performed in various ways. For example, a temperature profile or curve is created for the heating and cooling of the data display module. Based on this temperature profile, a lookup table is created that associates a time of activation with an estimated temperature, and estimated temperature change, or an estimated temperature compensating contrast level.

In step 24, the contrast level of the data display module is adjusted according to the estimate made in step 22.

Figure 3A:
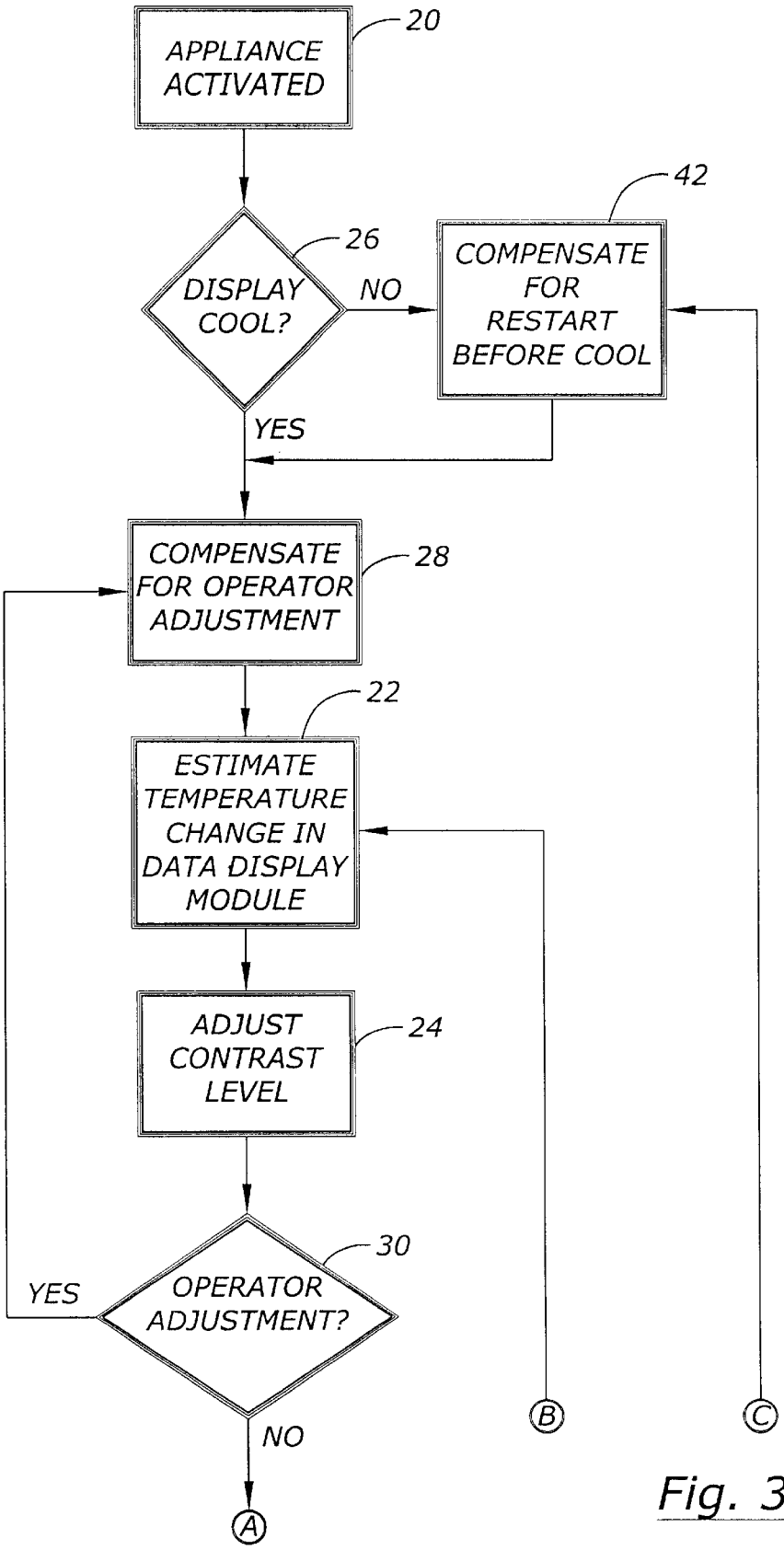
FIGS. 3A and 3B provide a flow chart of the method of the present invention.
Figure 3B:
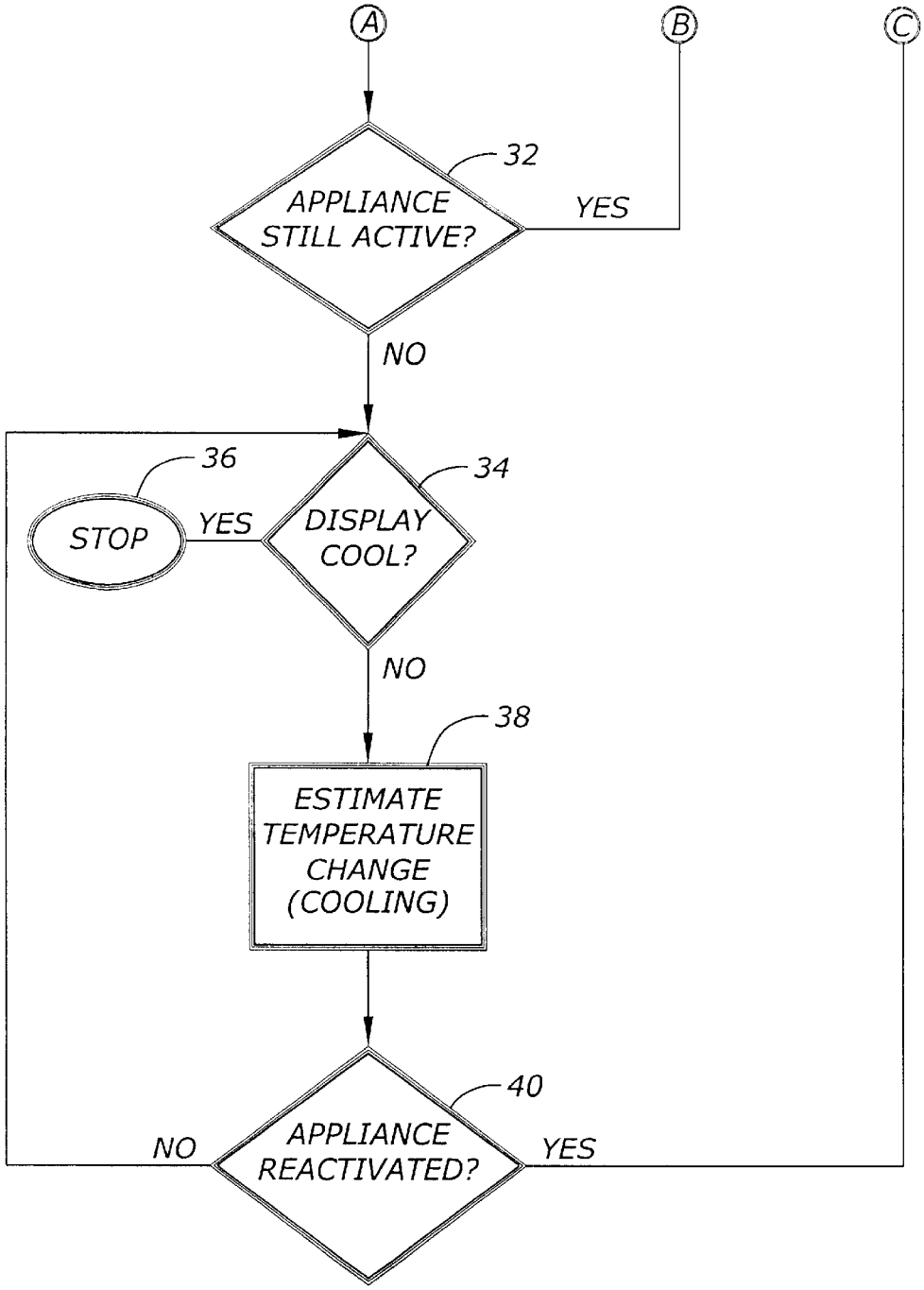

FIGS. 3A and 3B show a flow chart of a method of the present invention. The method shown includes step 20 where the appliance is activated. In step 26, a determination is made as to whether or not the display is cool. The display is cool when it is estimated or measured to be at approximately the ambient temperature. Alternatively, the display may be considered cool when the display is estimated or measured to be an idle temperature which may be different (i.e. higher) than the ambient temperature. For example, the display would not be cool when the appliance has been on for a long period and then the appliance is deactivated and then immediately reactivated again. When the display is not cool then in step 42 the temperature is compensated for in a restart of the appliance before the data display module is cool condition. This compensation can be provided for through use of an offset applied to a position in a lookup table or through an offset to a value derived from a lookup table.

The lookup table can contain theoretical or observed values for temperature, temperature change, contrast, contrast change, or other values from which compensation can be derived.

In step 28, an operator adjustment is compensated for. The present invention contemplates that an operator may manually adjust the contrast level of the data display module at any time, including during the time period which the appliance is active. The present invention may compensate for an operator adjustment of contrast level by applying an offset to the lookup table used to derive a contrast level. Alternatively, where a lookup table is used, a contrast level adjustment can be first retrieved from the lookup table and then an offset may be applied to the contrast level.

In step 30, the method determines whether an operator adjustment to the contrast level has occurred. If an adjustment level has occurred, then the adjustment is compensated for in step 28. If no adjustment has occurred, then in step 32 a determination is made as to whether the appliance is still active. If the appliance is still active then the temperature change in the data display module is estimated in step 22. If the appliance is not still active then in step 34 a check is made to determine whether or not the data display module is cool or at approximately the ambient temperature or the idle temperature. If the display is cooled to an ambient temperature or an idle temperature then in step 36 the monitoring process may stop. If the display is not cooled to an ambient temperature, then in step 38 an estimate as to the temperature change due to cooling is made. The temperature change due to cooling may be computed or retrieved from a lookup table similar to the step used to estimate the temperature change due to heating effects. This value may be stored or otherwise monitored for use in step 42.

In step 40 a determination is made as to whether the appliance is reactivated. If the appliance is not reactivated then in step 34 a check can be made to determine whether the display has cooled to ambient temperature or an idle temperature. If the appliance is reactivated then in step 42, compensation can be made for the restart or reactivation of the appliance before the data display module is fully cool. This compensation can be made by taking into account the estimate of the temperature change due to cooling in step 38. When a lookup table is used to determine temperature in the method of the present invention, an offset can be added to the position of the table or else an offset can be added to a result derived from the table.

Figure 4:
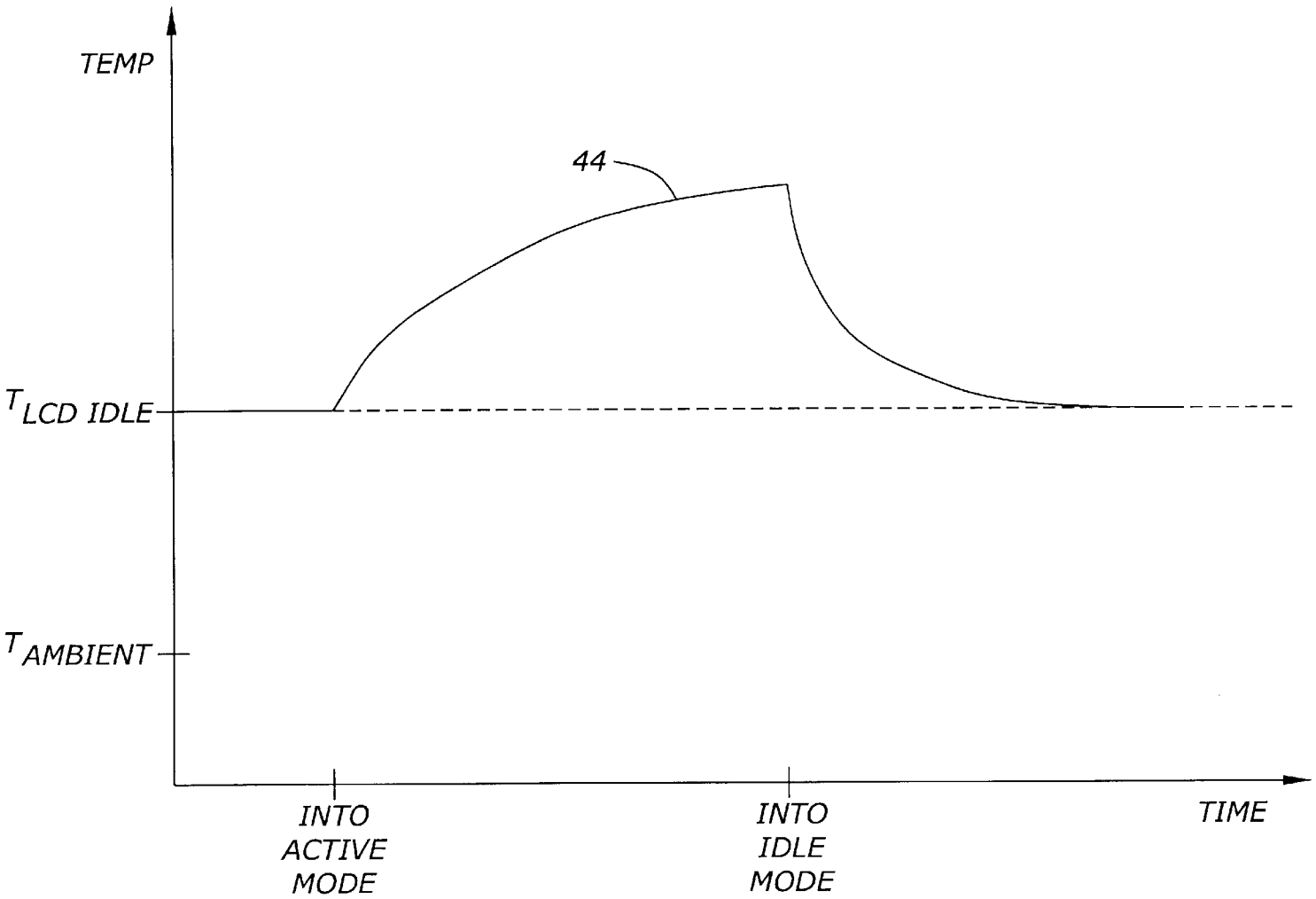
FIG. 4 is a graph of temperature versus time for an appliance of the present invention.

FIG. 4 shows a graph of temperature versus time for an appliance of the present invention. In FIG. 4, this relationship 44 is plotted. As can be shown in FIG. 4, there is an idle temperature associated with the LCD display. This idle temperature may be different from the ambient temperature such as being higher than the ambient temperature. The LCD display will retain this idle temperature until the appliance and/or data display enters an active mode. Once the active mode is entered, the temperature begins to increase until the appliance falls back into an idle mode or until an equilibrium temperature is reached. Once the idle mode is entered, the temperature then decreases over time to the idle temperature.

Figure 5:
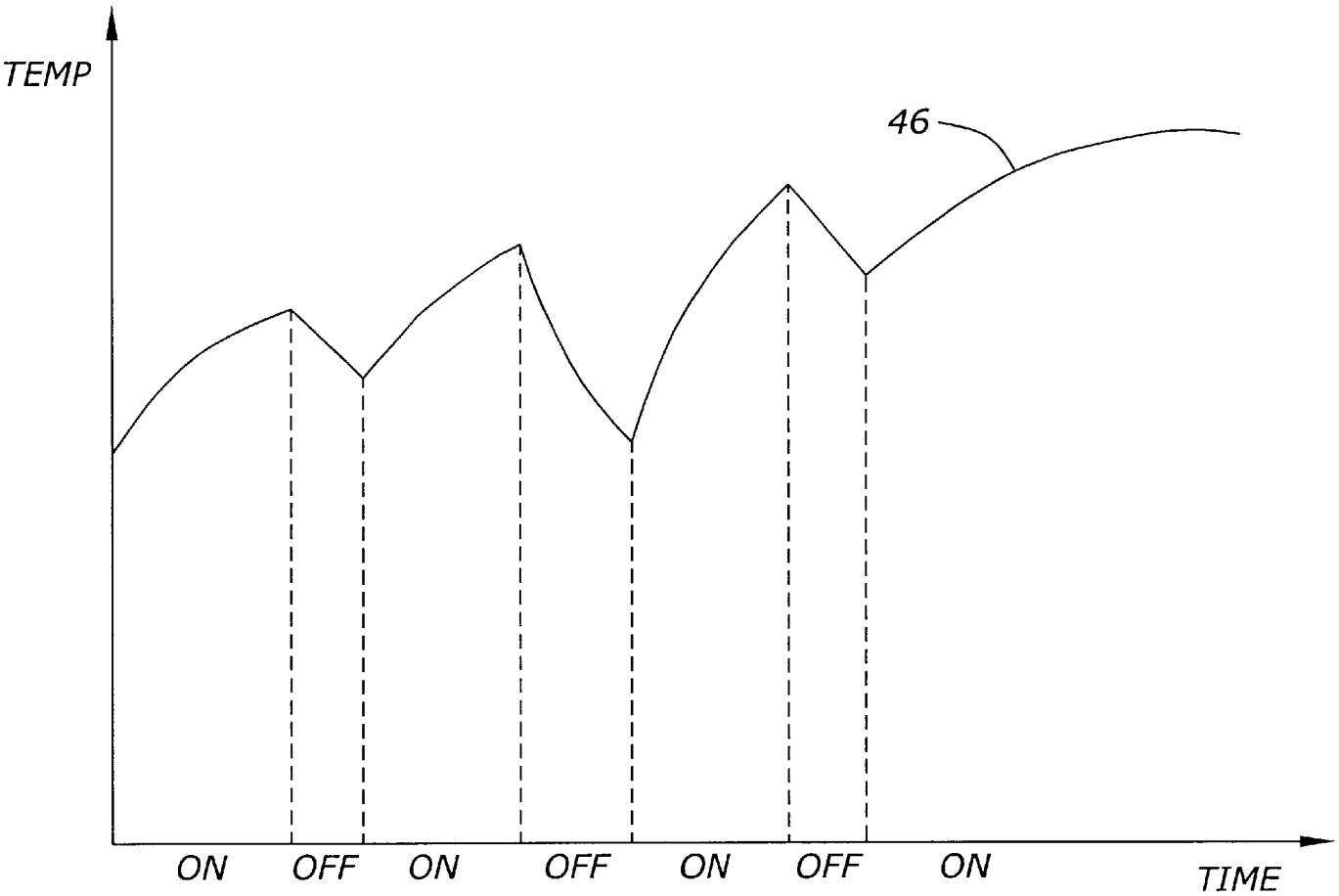
FIG. 5 is a graph of temperature versus time showing on and off periods for the appliance of the present invention.

FIG. 5 is a graph of temperature versus time showing on and off periods for the appliance of the present invention. In FIG. 5, the relationship 46 is shown where the temperature has not fully reached an idle state but rather the appliance is turned on and then off without fully cooling. The present invention contemplates compensating for temperature despite any number of conditions which may occur, such as the appliance fluctuating between an active state and an idle state, a user manually adjusting the contrast as well as other conditions and events.

Thus, an apparatus and method for automatically adjusting the contrast level of a data display module in an appliance has been disclosed which solves problems and deficiencies in the art. The present invention contemplates variations in the implementation of the method of the present invention including the type of appliance, the type of intelligent control, the type of data storage, the type of data display driver, the type of data display module, compensation for operator adjustment, and other variations.

The present invention further contemplates that the temperature curves or profiles used are based on an ambient temperature or an idle temperature. Most appliances are installed in a normal ambient temperature. The present invention contemplates that the ambient temperature and/or the idle temperature used may be adjusted to better correspond with the ambient temperature of a particular location. The ambient temperature and/or the idle temperature may be manually adjusted or may be set in software or may be determined by a temperature sensor electrically connected to the intelligent control. When a temperature sensor is used, the temperature sensor need not be connected to the data display module itself as only the ambient temperature and/or the idle temperature and not the data display module temperature is to be measured.

What is claimed is:

1. An electronically controlled cooking appliance comprising:

an intelligent control electrically connected to the cooking appliance and adapted for controlling the cooking appliance;

a data display module capable of contrast adjustment electrically connected to the intelligent control; and a data storage medium electrically connected to the intelligent control for storing software instructions for monitoring the amount of time the cooking appliance is in an active state and instructions for compensating for the temperature change associated with the amount of time and adjusting accordingly the contrast level of the data display module.

2. The electronically controlled appliance of claim 1 wherein the data display module is a liquid crystal display panel.

3. A method for automatically adjusting a contrast level of a data display module in a cooking appliance comprising:

determining whether the cooking appliance is in an active state and if so, an amount of time the cooking appliance has been in the active state;

estimating the temperature change in the data display module to be compensated for based upon the amount of time the cooking appliance has been in the active state; and adjusting the contrast level of the data display module to compensate for the temperature change in the data display module.

4. The method of claim 3 further comprising compensating for a condition wherein the appliance enters the active state prior to cooling to an idle temperature.

5. The method of claim % wherein the step of adjusting the contrast level includes compensating for user adjustment of the contrast level.

6. The method of claim 3 wherein the step of estimating the temperature change in the data display module includes measuring the amount of time the appliance has been in the active state and looking up a compensation level associated with the amount of time the appliance has been in the active state.

7. The method of claim 3 wherein the estimated temperature change is the difference between a current temperature and an idle temperature.

* * * * *